US007992584B1

(12) United States Patent
Birnbaum

(10) Patent No.: US 7,992,584 B1
(45) Date of Patent: Aug. 9, 2011

(54) WALKER WITH RETRACTABLE WHEELS

(76) Inventor: Bernardo Birnbaum, Miami, FL (US)

( * ) Notice: Subject to any disclaimer, the term of this patent is extended or adjusted under 35 U.S.C. 154(b) by 0 days.

(21) Appl. No.: 12/763,310

(22) Filed: Apr. 20, 2010

(51) Int. Cl.
*A61H 3/04* (2006.01)

(52) U.S. Cl. ..... 135/67; 135/82; 135/85

(58) Field of Classification Search ..... 135/67, 135/84, 85; 482/68
See application file for complete search history.

(56) References Cited

U.S. PATENT DOCUMENTS 3,237,940 A * 3/1966 Johnson ..... 482/68
3,350,095 A * 10/1967 Clasen ..... 482/68
4,046,374 A * 9/1977 Breyley ..... 482/68
4,765,355 A * 8/1988 Kent ..... 135/67
5,133,377 A * 7/1992 Truxillo ..... 135/67
6,675,820 B2 * 1/2004 Balan ..... 135/67
7,334,592 B2 2/2008 Tartaglia ..... 135/85
2003/0094191 A1 * 5/2003 Lin ..... 135/65

* cited by examiner

*Primary Examiner* — Noah Chandler Hawk
(74) *Attorney, Agent, or Firm* — Sanchelima & Associates, P.A.

(57) ABSTRACT

A walker with wheels that are retracted upon the application of a force of predetermined magnitude to permit a user to move the walker when he or she partially leans on the walker while providing a solid anchored support if he or she leans with more weight exceeding a predetermined magnitude. The walker includes a structural elongated assembly with a handle and forearm cuff at one end. The other end is rigidly mounted to two base assemblies that are kept at a parallel and spaced apart relationship with respect to each other. The base assemblies have a bottom surface. Retractable wheels are mounted to the base assemblies. The wheels are spring biased to protrude beyond the bottom surface so that they support the walker when at rest and as long as the user does not apply a force that exceeds a predetermined magnitude.

2 Claims, 5 Drawing Sheets

WALKER WITH RETRACTABLE WHEELS

BACKGROUND OF THE INVENTION

1. Field of the Invention

The present invention relates to a wheeled walker, and more particularly, to such a walker that includes retractable wheels.

2. Description of the Related Art

Several designs for wheeled walkers have been designed in the past. None of them, however, includes retractable wheels that permit a user to lean on the walker as he or she moves and using it as a non-moving support upon exceeding a predetermined force magnitude with his or her weight.

Applicant believes that the closest reference corresponds to U.S. Pat. No. 7,334,592 issued to Tartaglia on Feb. 26, 2008 for a rolling cane. Tartaglia's patent shows a wheeled device 100, with a handle 330 that provides stability to a user. To achieve a fixed position of device 100, the patent discloses the use of brake 400. However, it differs from the present invention because a user is required to actuate a separate brake mechanism 400 with the awkward movement of the heal of his/her hand. In the present invention, a user does not need to lift his/her hands from the handle since he/she only needs to apply more or less weight thus overcoming the spring loaded brakes associated with the wheels.

Other patents describing the closest subject matter provide for a number of more or less complicated features that fail to solve the problem in an efficient and economical way. None of these patents suggest the novel features of the present invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
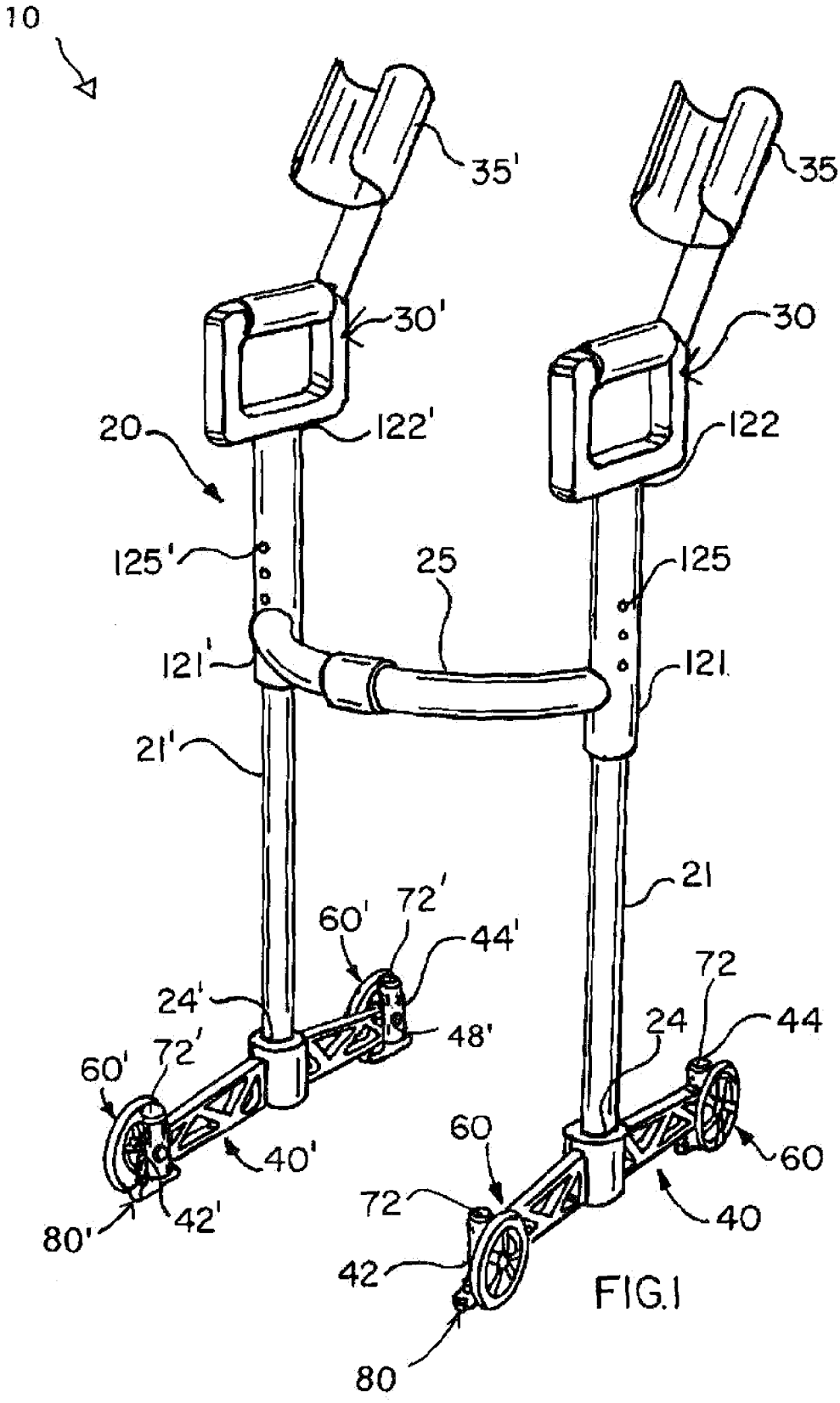
FIG. 1 represents an isometric view of one of the embodiments for the present invention.

Referring now to the drawings, where the present invention is generally referred to with numeral 10, it can be observed that it basically includes a structural assembly 20 having two elongate members 21 and 21' with lower ends 24; 24' and two elongate tubular sleeve members 121; 121' with upper ends 122; 122', respectively, elongate base assemblies 40; 40' mounted perpendicularly to ends 24; 24', with retractable wheel assemblies 60; 60'.

Structural assembly 20 includes elongate members 21; 21' telescopically and partially inserted with tubular sleeve members 121; 121', respectively, that are kept at a parallel and spaced apart relationship with respect to each other by transversal spacer 25. Spacer 25 has preferably a curved shape that cooperates to clear some space that permits a user to get closer to the area between the spaced apart assemblies 40; 40', for more stability. Members 21; 21' are telescopically adjustable to conform to a user's needs and comfort. One of the means for adjusting the effective height of members 21; 21' and 121; 121' includes the use of through openings 125 and 125' in tubular sleeves 121'; 121'. Other equivalent means can be used to provide engagement to telescopically adjustable members 21; 21'.

Upper ends 122; 122' have handles 30; 30' mounted thereon with removable forearm support cuff assemblies 35; 35' extending at an angle from handles 30; 30', as seen in FIG. 1. Handles 30; 30' further include frame 32 and opening 39. When tubular member 38 is inserted into frame 32, opening 39 cammingly receives spring loaded protuberance 37 which is mounted to tubular member 38 in forearm support cuff assembly 35 allowing for forearm support cuff assembly 35 to be securely and removably fastened to handle 30.

Lower ends 24; 24' have base assemblies 40; 40' mounted thereon and kept at a spaced apart and parallel relationship with respect to each other.

Figure 1A:
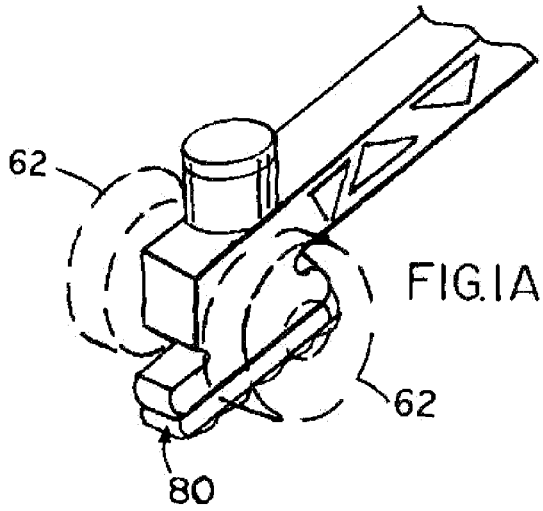
FIG. 1A represents an isometric partial view of an alternate embodiment for the wheel assembly wherein two wheel members (shown in broken lines) are used.

As seen in FIG. 1, base assemblies 40; 40' have forward ends 42; 42' and rear ends 44; 44' that support pad assemblies 80; 80'. Bottom surfaces 86; 86' of pad assemblies 80; 80' selectively come in contact with a supporting surface S (typically a substantially horizontal surface). Retractable wheel assemblies 60; 60' are mounted adjacent to forward ends 42; 42' and rear ends 44; 44', as shown in FIG. 1. FIG. 1A shows an alternate embodiment with two wheels 62, instead of one, for even better stability.

Figure 2:
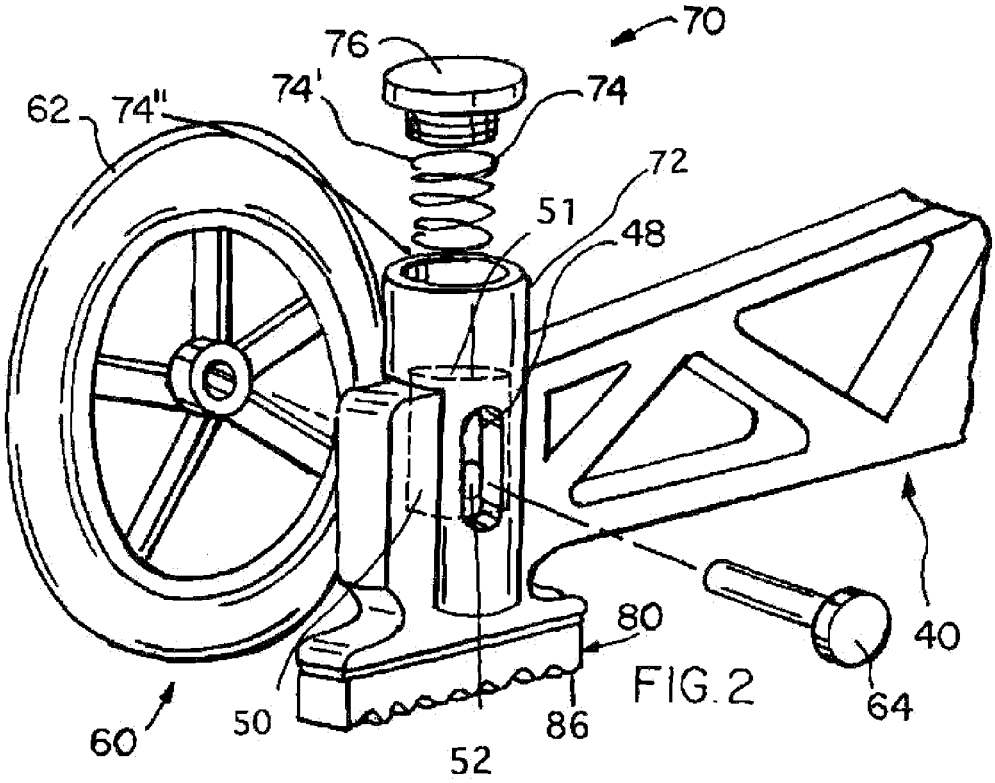
FIG. 2 shows an enlarged isometric partial view of base assembly 40 showing one of the retractable wheel assemblies for the embodiment shown in FIG. 1.
Figure 3:
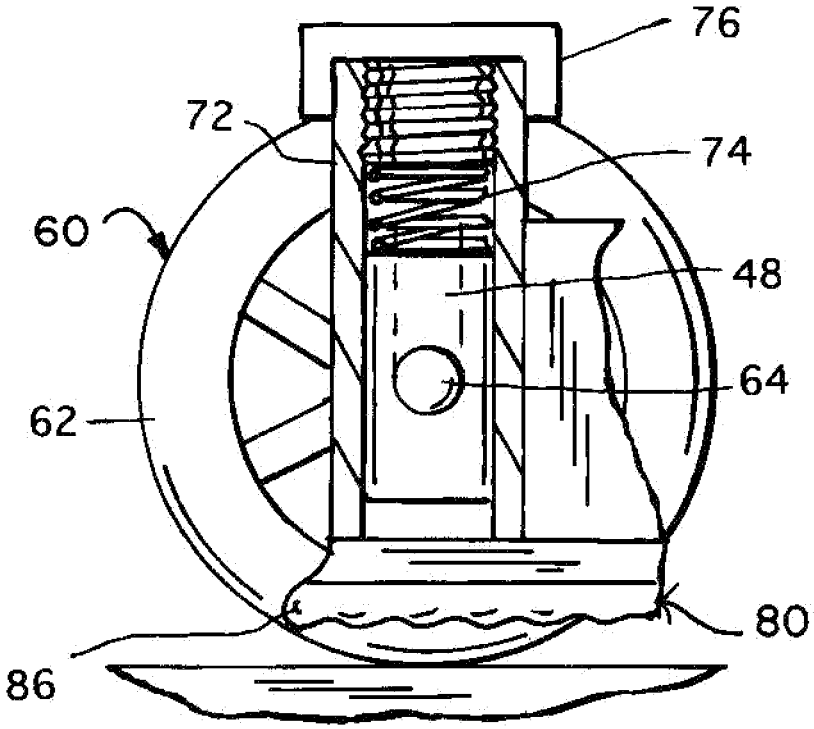
FIG. 3 illustrates an elevational view of the wheel assembly shown in the previous figure with a partial cross-section of the spring housing and the brake pad 80 shown without making contact with the supporting surface.
Figure 3A:
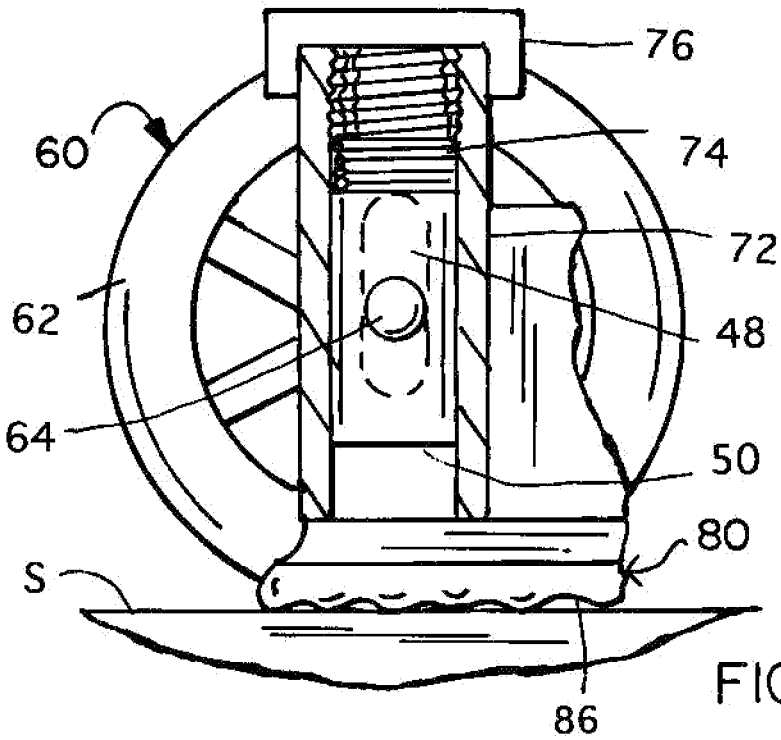
FIG. 3A represents an elevational view of the wheel assembly shown in the previous figure with a partial cross-section of the spring housing and the brake pad making contact with the supporting surface.
Figure 4:
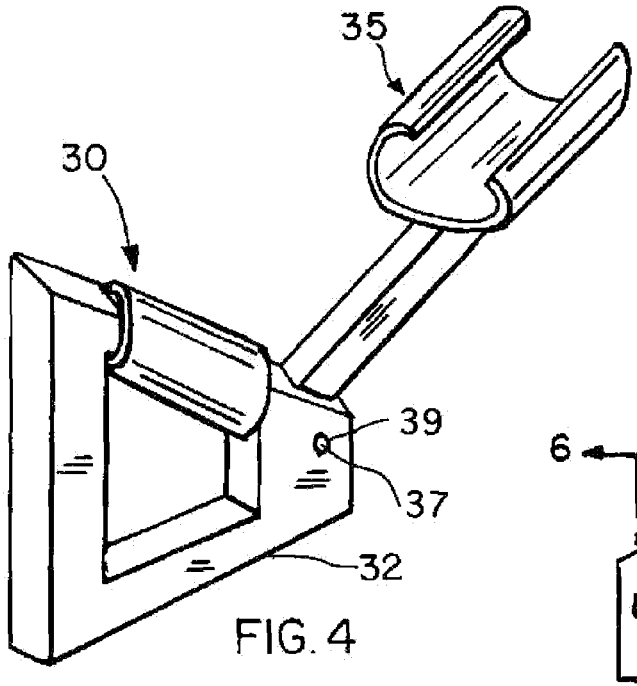
FIG. 4 shows an isometric enlarged view of the handle 30 and forearm cuff assemblies 35.
Figure 5:
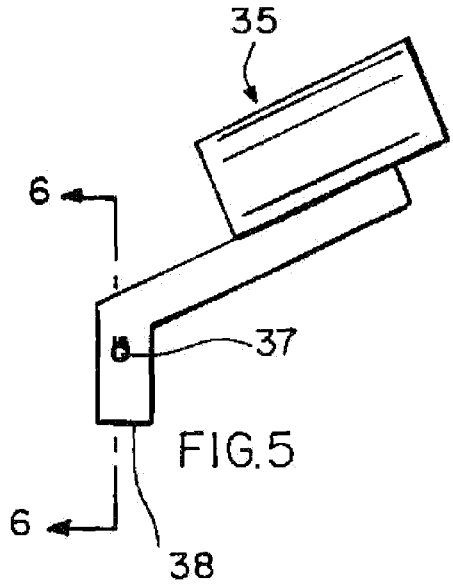
FIG. 5 shows a side elevational view of the forearm cuff 35 including tubular member 38.
Figure 6:
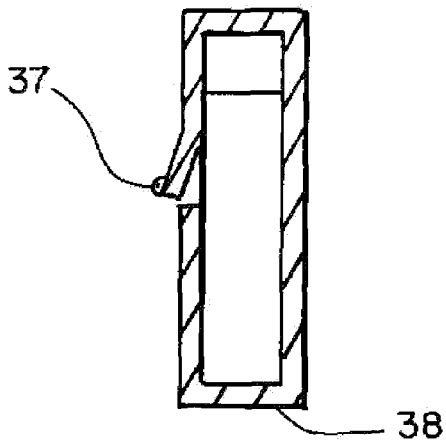
FIG. 6 is a cross-section of tubular member 38 along line 6-6 showing spring locking protuberance 37.

Wheel assemblies 60 (and 60') are best seen in FIGS. 2; 3 and 3A where wheel member 62 is mounted to axle 64 which in turn is journaled within slot 48 of base assembly 40 and moving bushing member 50 within housing 72. Spring biasing assembly 70 includes, in one of the embodiments, spring housing 72 wherein spring member 74 is received and compressed by cap 76. Cap 76 comes in contact with one end 74' of spring member 74 and the other end 74" coacts with the upper end 51 of bushing 50. Axle 64 is passed through through hole 52. Spring 74 coacts with bushing member 50 which in turn coacts with axle 64 to urge wheel member 62 down and beyond bottom surfaces 86; 86' so that, at rest, walker 10 is supported by wheel assemblies 60; 60' and not bottom surfaces 86; 86'.

Figure 7:
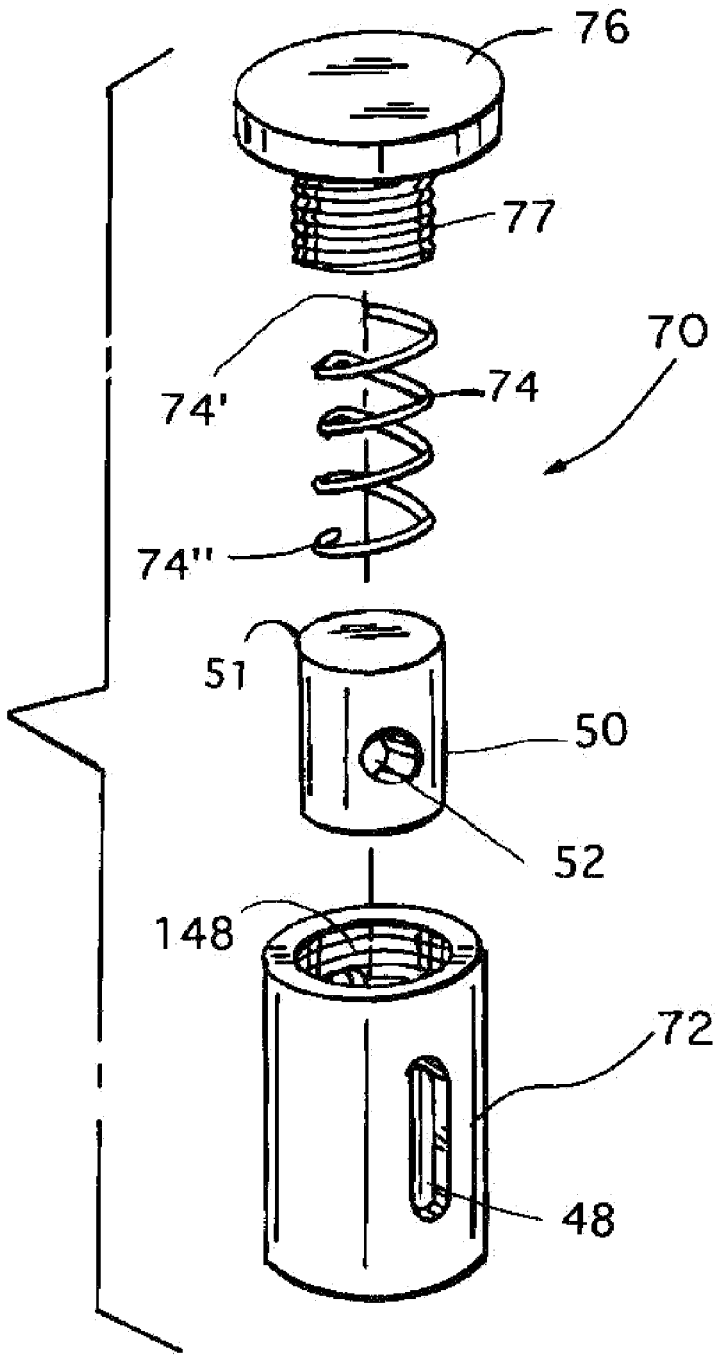
FIG. 7 illustrates an enlarged exploded view of the spring biasing assembly 70.

Retractable wheel assemblies 60 (and 60') include spring housings 72 (and 72') for slidably housing therein moving bushing member 50 and spring member 74 coacting with the former. Instead of a helical spring 74, an equivalent element could be using a resilient member such as a rubber cylinder inside housing 72. Spring housing 72 includes two longitudinally extending slots 48 and 148' (shown in FIG. 7), opposite to each other, and having cooperating dimensions to receive therethrough wheel axle 64. Housing 72' also has a slot opposite to slot 48' and it is not shown. In this manner, the axial travel of transversely disposed wheel axle 64 is limited between two extreme positions. The width of slots 48 and 148' is slightly larger than the diameter of wheel axle 64 so that the latter is axially guided with relatively small lateral movements. Bushing member 50 has cooperative dimensions that permit it to be slidably housed within spring housing 72. Bushing member 50 includes a transversal through hole 52 that cooperatively receives wheel axle 64. Spring member 74 is mounted adjacent to bushing member 50 with one end 74' coacting against the upper end surface 51 of bushing member 50 and the other end coacting against the inner surface 77 of cap 76, the latter being removably mounted to one end of spring housing 72. In this manner, in this embodiment, spring 74 is compressed within housing 72 urging bushing member 50 away from cap 76. Since wheel axle 64 is inserted through through hole 52, the former is kept at the farthest position with respect to cap 76 when there is no force (weight) applied by a user. As a user leans on handles 30 and 30', a portion of his/her weight is transmitted down members 21 and 21' forcing spring 74 to compress and axle 64 starts moving towards cap 76. At some point, the weight applied is enough (typically when a user is not moving but rather stationary in one place) to bring pad assemblies 80 (and 80') in contact with the supporting surface. At this point, cart 10 will not move and the position is fixed with a stable structure.

The selection of the magnitude of force (weight) required for the user to engage pad assembly 80 will depend on his/her preferences. The size and other characteristics of spring 74 will be selected accordingly. It is also possibly to use a mechanism for adjusting the travel of spring 74. The result is that device 10 permits a user, without lifting his/her hands from handles 30 and 30', to use it to provide stability while moving (walking) and permitting the user to select a fixed stable position for leaning. Upon removal of his/her weight, wheel assemblies 60; 60' come back to provide the support for the walker The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A walker comprising:

A) a structural assembly having first and second substantially straight elongate members each having lower and upper ends and a spacer member for keeping said first and second elongate members at a parallel and spaced apart relationship with respect to each other;

B) first and second supporting elongate base assemblies each including a pad assembly having a bottom surface that selectively comes in contact with a supporting surface, said supporting base assemblies being mounted substantially perpendicularly to said lower ends, each of said base assemblies having forward and rear ends; and C) first and second wheel assemblies mounted to each of the forward and rear ends, respectively, of said first and second supporting elongate base assemblies, each wheel assembly having at least one wheel with a corresponding centrally disposed axle at a cooperative location for said wheels to protrude beyond said bottom surfaces, each of said wheel assemblies further including a retracting assembly for causing said first and second wheel assemblies to retract upon the application of a force of a predetermined magnitude to said structural assembly to urge said bottom surfaces against said supporting surface and said retracting assembly further including a spring housing coplanarly mounted to said forward and rear ends, each spring housing having two opposite guide slots with cooperative dimensions to receive a slidable bushing with a through hole for journaling said axles transversally disposed with respect to the straight elongate base assemblies and the wheels rotate on the axles passed through said slots and a spring member for biasing said bushing so that when said force is below a predetermined magnitude said first and second wheels provide the support for said walker.

2. The walker set forth in claim 1 wherein said spring biasing assembly includes a bushing member that cooperatively coacts with said axle to transmit the expansion force of said spring member.

* * * * *